US010927570B2

(12) United States Patent
Talpe

(10) Patent No.: US 10,927,570 B2
(45) Date of Patent: Feb. 23, 2021

(54) LOCK FOR A HINGED CLOSURE MEMBER

(71) Applicant: LOCINOX, Waregem (BE)

(72) Inventor: Joseph Talpe, Heestert-Zwevegem (BE)

(73) Assignee: LOCINOX, Waregem (BE)

( * ) Notice: Subject to any disclaimer, the term of this patent is extended or adjusted under 35 U.S.C. 154(b) by 97 days.

(21) Appl. No.: 16/172,587

(22) Filed: Oct. 26, 2018

(65) Prior Publication Data

US 2020/0131805 A1 Apr. 30, 2020

(51) Int. Cl.

| | |
|---|---|
| ***E05B 59/00*** | (2006.01) |
| ***E05B 55/12*** | (2006.01) |
| ***E05B 63/00*** | (2006.01) |
| ***E05B 63/18*** | (2006.01) |
| ***E05B 63/06*** | (2006.01) |
| ***E05B 15/04*** | (2006.01) |
| ***E05B 63/04*** | (2006.01) |

(52) U.S. Cl.

CPC ..... *E05B 59/00* (2013.01); *E05B 15/04* (2013.01); *E05B 55/12* (2013.01); *E05B 63/0021* (2013.01); *E05B 63/044* (2013.01); *E05B 63/06* (2013.01); *E05B 63/18* (2013.01); *E05B 2015/0413* (2013.01)

(58) Field of Classification Search

CPC ..... E05B 59/00; E05B 63/044; E05B 63/18; E05B 63/0021; E05B 63/06; E05B 15/04; E05B 55/12; E05B 2015/0413; E05B 63/14; E05B 65/0007

USPC ..... 70/104, 106–111, 134, 150, 151 R, 70/151 A, 153, DIG. 6, DIG. 60, DIG. 63; 292/33, 34

See application file for complete search history.

(56) References Cited

U.S. PATENT DOCUMENTS 2,854,839 A * 10/1958 Eads ..... E05B 63/0013 70/139
2,989,859 A * 6/1961 Eads ..... E05B 63/0013 70/116
3,011,817 A * 12/1961 Eads ..... E05B 63/0017 292/140
RE26,677 E * 10/1969 Russell et al. ..... E05B 59/00 292/34

(Continued)

FOREIGN PATENT DOCUMENTS

EP 1118739 A1 * 7/2001
EP 2915939 A1 * 9/2015

*Primary Examiner* — Lloyd A Gall

(74) *Attorney, Agent, or Firm* — Christensen O'Connor Johnson Kindness PLLC

(57) ABSTRACT

A lock comprising a latch bolt and a dead bolt, a dead bolt lever to move the dead bolt, a key actuated cylinder with a rotary driving bit, a second turn latch bolt lever to move the latch bolt by using the key, a second turn latch bolt driver as an intermediary between the driving bit and the second turn lever, a spring urging the second turn driver in the path of the driving bit, and a locking mechanism to lock the dead bolt. The second turn driver comprises a follower portion which, upon actuation by the driving bit, moves the second turn driver out of the path of the driving bit thereby preventing the driving bit from being blocked. The locking mechanism comprises a slot having two catches and a spring biased lever mounted on the dead bolt lever to lock the dead bolt lever.

20 Claims, 11 Drawing Sheets

(56) References Cited

U.S. PATENT DOCUMENTS

| | | | | | |
|---|---|---|---|---|---|
| 3,699,788 | A * | 10/1972 | Gerlach | E05B 63/0017 | 70/134 |
| 4,012,929 | A * | 3/1977 | Solovieff | E05B 63/0017 | 70/134 |
| 4,127,016 | A * | 11/1978 | Ibsen | E05B 63/0013 | 292/196 |
| 4,848,118 | A * | 7/1989 | Tesone | E05B 15/10 | 70/419 |
| 5,301,525 | A * | 4/1994 | Doring | E05B 59/00 | 292/34 |
| 5,317,890 | A * | 6/1994 | Wu | E05B 63/0021 | 292/150 |
| 6,302,456 | B1 * | 10/2001 | Errani | E05B 59/00 | 292/165 |
| 6,851,287 | B1 * | 2/2005 | Yang | E05B 65/1086 | 292/150 |
| 7,497,486 | B1 * | 3/2009 | Davis | E05B 15/0205 | 292/169.14 |
| 8,875,549 | B2 * | 11/2014 | Chang | E05B 63/0021 | 292/34 |
| 2003/0033839 | A1 * | 2/2003 | Chen | E05B 63/0017 | 70/107 |
| 2006/0123859 | A1 * | 6/2006 | Gonzalez | E05B 59/00 | 70/107 |
| 2010/0263418 | A1 * | 10/2010 | Moon | E05B 59/00 | 70/107 |

* cited by examiner

LOCK FOR A HINGED CLOSURE MEMBER

BACKGROUND

Locks for a hinged closure member, such as gates, doors and fences are known. A first type of locks relies on the use of two individual key actuated cylinders to operate the lock from either side of the hinged closure member. Such a lock is disclosed in U.S. Pat. No. 7,497,486 and US-A-2010/0263418. These locks have a dead bolt and a latch bolt, both operable to be moved in a retracted and a projecting position. The dead bolt is operated by a dead bolt lever. The latch bolt is operated by a latch bolt lever which is connected to a handle. The lock further has a key operated cylinder with a rotary driving bit. The rotary driving bit engages the dead bolt lever to move the dead bolt between its retracted and projecting positions. In both of these positions the dead bolt is locked due to the interaction of the dead bolt lever with the dead bolt which both have inclined surfaces that engage one another. Specifically, the free extremity of the dead bolt lever engages with a first inclined surface of the dead bolt when the dead bolt is retracted and with a second inclined surface of the dead bolt when the dead bolt is projected. Due to the inclination of the surfaces, any force exerted onto the dead bolt does not create a torque of the dead bolt lever.

The known locks also have a second turn action, meaning that a second turn of either one of the key actuated cylinders moves the latch bolt into its retracted position. Specifically, upon the first turn of either one of the key actuated cylinders, the rotation of the dead bolt lever also results in a tilting of a second turn latch bolt driver such that one end thereof is moved into the circular path of the rotary driving bit on the key actuated cylinders. Due to this tilt, the rotary driving bit will, upon a second turn of either one of the key actuated cylinders, engage with the second turn latch bolt driver to move the latch bolt by operation of the key of the key actuated cylinder.

A drawback of the locks disclosed in U.S. Pat. No. 7,497,486 and US-A-2010/0263418 is that they cannot be mounted on the post of a gate with the latch bolt and the dead bolt extending entirely through the post. The bolts indeed do not have a sufficient length. Moreover, the mounting mechanisms used to mount the bolts on the lock frame are not strong enough to handle the increased forces that the bolts may be subjected to when they are fully extended. Specifically, when the bolts are fully extended and are subjected to a lateral force, the torque exerted onto the mounting mechanisms of the bolts increases with the length of the bolts.

A further inconvenience with locks of this type is that the stroke of the dead lock, or in other words the distance over which the dead lock is moved when going from its projecting position to its retracted position or vice versa, is determined by the length of the dead bolt lever and the available depth of the hole in the door wherein the lock is to be mounted. Consequently, the stroke of the dead bolt is limited and may not be sufficient in certain outdoor applications where a larger stroke is preferred. Indeed, in case of gates or fences, the lock catcher is usually fixed to a pole placed in a hole in the ground. Although this hole is usually filled with concrete, the pole may move somewhat, especially after some time under the influence of frost or moisture or when a force is exerted thereon for example by a burglar who tries to force the pole away from the lock. It will be clear that the larger the stroke of the dead bolt, the more difficult it will be to withdraw the dead bolt from the lock catcher by removing the pole from the gate or fence.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In order to achieve a larger stroke, it is already known to provide a two-turn lock, which requires two turns of the key in order to project the dead bolt over its maximum distance out of the lock. However, turning the key two times is a cumbersome operation so that in practice, the key will often only be turned once.

A solution to this problem for a second type of locks was disclosed in EP-B-1118739. Locks of this second type rely on the use of a single key actuated cylinder that extends through the lock in order to be operable from both sides. The lock disclosed in EP-B-1118739 has a dead bolt and a latch bolt, both operable to be moved in a retracted and a projecting position. The dead bolt is operated by a dead bolt lever. The latch bolt is operated by a latch bolt lever which is connected to a handle. The lock further has a key operated cylinder with a rotary driving bit. The rotary driving bit engages the dead bolt lever to move the dead bolt between its retracted and projecting positions. In both of these positions the dead bolt is locked by means of locking plate which can be moved upwards, against the action of a spring, by means of the rotary driving bit to unlock the dead bolt just before it is displaced by means of the rotary driving bit. The lock further has a second turn latch bolt lever rotatably mounted on the frame of the lock to move the latch bolt from its projecting position to its retracted position and a second turn latch bolt driver pivotally connected between the second turn latch bolt lever and slidably to the dead bolt lever to rotate the second turn latch bolt lever. The rotary driving bit is engaging the second turn latch bolt driver to move the latch bolt by operation of the key of the key actuated cylinder.

A problem with this known lock is that when the dead bolt is undergoing a lot of resistance during operation towards the projecting position of the dead bolt, the rotary driving bit and dead bolt lever may be forced into a relative positioning wherein it is no longer possible to rotate the dead bolt lever with the rotary driving bit. In particular, the rotary driving bit may get stuck between the free extremity of the dead bolt lever and the actuation portion of the second turn latch bolt driver when the dead bolt is not correctly locked by the locking means of the lock and is pushed into its retracted position again by a resilient force exerted onto the dead bolt during locking. Alternatively, the rotary driving bit may have passed the actuation portion of the second turn latch bolt driver during a second turn when opening the lock. In those situations the dead bolt cannot be moved anymore and the lock is blocked. An intervention of a technician is needed to unlock the blocked lock.

This problem has already been addressed in the lock disclosed in EP-B-2915939. EP-B-2915939 proposes to solve this problem by providing an auxiliary engagement portion on the dead bolt for engaging the rotary driving bit when said rotary driving bit is rotated in the locking direction.

An inconvenience of the locks disclosed in EP-B-1118739 and EP-B-2915939 is that they operate using a single key actuated cylinder having a centrally placed rotary driving bit which can directly act on both the dead bolt lever and the locking plate. In other words, they cannot be provided with two independent lock cylinders, which is however the common practice in some countries, for example in the United States of America. On the other hand, the locks disclosed in U.S. Pat. No. 7,497,486 and US-A-2010/0263418 have rotary driving bits which are located near the sides of the lock. Consequently, there is no straightforward way to integrate the desired features of the locks disclosed in EP-B-1118739 and EP-B-2915939 into the locks disclosed in U.S. Pat. No. 7,497,486 and US-A-2010/0263418 due to, among others, different locations where forces are exerted by rotary driving bits and different objects onto which these need to be exerted.

The present disclosure relates to a lock for a hinged closure member, in particular a gate or door, and more particular to a safety lock for outside gates, doors or fences which allow to open the gate or door with a key.

According to a first aspect of the disclosure, there is provided a lock for a hinged closure member. The lock comprises: a frame; a dead bolt slidably mounted on the frame between a retracted position and a projecting position; a dead bolt lever which is in particular pivotally connected to the dead bolt and which is pivotally mounted on the frame between a first angular position, wherein the dead bolt is in its retracted position, and a second angular position, wherein the dead bolt is in its projecting position; a first mounting means on a first face of the lock provided for mounting a first key actuated cylinder having a first rotary driving bit on the frame; a second mounting means on a second face, opposite said first face, of the lock provided for mounting a second key actuated cylinder having a second rotary driving bit on the frame, wherein each rotary driving bit is rotatable upon actuation of the respective key actuated cylinder along a locking direction and an unlocking direction, opposite to said locking direction, each rotary driving bit being arranged to be rotated in said unlocking direction to act upon a respective first actuation element provided on the dead bolt lever to pivot the dead bolt lever from its second into its first angular position and to be rotated in said locking direction to act upon a respective second actuation element provided on the dead bolt lever to pivot the dead bolt lever from its first into its second angular position, wherein the first actuation elements are provided on opposite sides of the dead bolt lever and wherein the second actuations elements are provided on opposite sides of the dead bolt lever; and a locking mechanism arranged to lock the dead bolt in its retracted and its projected position. The locking mechanism comprises: a spring biased lever mounted on the dead bolt lever and having a locking member; a first catch provided on the frame; and a second catch provided on the frame, wherein said locking member is urged by said spring biased lever in said first catch when the dead bolt lever is in its first angular position to lock the dead bolt lever and thereby said dead bolt in its retracted position and wherein said locking member is urged by said spring biased lever in said second catch when the dead bolt lever is in its second angular position to lock the dead bolt lever and thereby said dead bolt in its projecting position, wherein each rotary driving bit is arranged to, when the rotary driving bit is being rotated in said locking direction, act upon said locking member before the rotary driving bit acts upon its respective second actuation element on the dead bolt lever to move said locking member out of said first catch to unlock said dead bolt from its retracted position and to, when the rotary driving bit is being rotated in said unlocking direction, act upon said locking member before the rotary driving bit acts upon its respective first actuation element on the dead bolt lever to move said locking member out of said second catch to unlock said dead bolt from its projecting position.

By providing a locking mechanism that is mounted onto the dead bolt lever, and is thus moving therewith, it is possible to actuate the locking mechanism from both sides of the dead bolt lever. Especially, each rotary driving bit acts directly upon its own side of the locking member. This avoids side-effects, such as torque, that occur when the movement of one of the rotary driving bits would be transferred transversally through the lock to act upon a locking member that is only located on a single side of the dead bolt lever, which is the case with the locking plate of the locks disclosed in EP-B-1118739 and EP-B-2915939.

Furthermore, by providing a locking mechanism which does not require a specific interaction of a free extremity of the dead bolt lever with the dead bolt as in the locks disclosed in U.S. Pat. No. 7,497,486 and US-A-2010/0263418, there are fewer limitations on the size of the dead bolt lever.

Moreover, by providing the locking mechanism on both sides of the dead bolt lever, the central area within the lock is kept relatively free. Consequently, a dead bolt lever as used in EP-B-1118739 and EP-B-2915939 may be used.

In an embodiment of the disclosure, the spring biased lever is pivotally mounted on the dead bolt lever by means of a pivot and comprises a first end-part on a first side of the pivot and a second end-part on a second side of the pivot, opposite the first side, wherein the locking mechanism comprises a spring having a first end connected to the dead bolt lever and a second end connected to the second end-part of the spring biased lever, and wherein the locking member is provided on the first end-part of the spring biased lever.

A pivotal connection between the dead bolt lever and the spring biased lever is very sturdy and enables the provision of a strong spring to urge the locking member into either one of the catches. It also allows the rotary driving bits to exert relatively large forces onto the spring biased lever without deforming this lever or its pivot axis. In particular, this construction is relatively compact, especially when compared to a leaf spring with a similar strength.

Preferably, the spring biased lever comprises two arms on opposite sides of the dead bolt lever, each arm being pivotally mounted on the dead bolt lever, said two arms being connected by the locking member on the first end-part of the spring biased lever. Advantageously, said two arms are further connected by a transverse connection provided on the second end-part of the spring biased lever, said second end of the spring being fixed to the transverse connection.

The provision of two arms alleviates possible effects of torque, for example generated by the action of a rotary driving bit on the locking member, which locking member is preferably centrally slidably connected to the dead bolt lever. This is further improved by providing one or more additional transverse connections. Moreover, connecting the spring to a transverse connection enables a central placement of the spring with respect to the locking member.

In an embodiment of the disclosure, the dead bolt lever is pivoted about a pivot with respect to the frame and connects with the dead bolt on a first distance from said pivot to move the dead bolt from its retracted to its projecting position or vice versa, each of said rotary driving bits engaging the first and the second actuation elements on the dead bolt lever on a second distance from said pivot, which second distance is smaller than said first distance.

In this embodiment, the rotational motion of either one of the rotary driving bits is converted into the translational motion of the dead bolt through the intermediary of the dead bolt lever. Since the driving bit engages the dead bolt lever on a smaller distance from the pivot of this lever than the distance between this pivot and the location where the lever engages the dead bolt, a lever effect is obtained resulting in a larger displacement of the dead bolt upon one turn of the rotary driving bit.

Furthermore, by the rotational motion of the dead bolt lever around its pivot, the part thereof where either one of the driving bits engages the lever does not follow a straight line, rather it follows a curved line. As a result of this rotational motion, the driving bit may engage the dead bolt lever over a longer part of its rotational motion also resulting in an increased stroke of the dead bolt.

In an embodiment of the disclosure, said first catch and said second catch are provided on the first face of the lock and the locking mechanism comprises a further first catch and a further second catch provided on the frame on the second face of the lock, wherein said locking member is urged by said spring biased lever in said further first catch when the dead bolt lever is in its first angular position to lock the dead bolt lever and thereby said dead bolt in its retracted position and wherein said locking member is urged by said spring biased lever in said further second catch when the dead bolt lever is in its second angular position to lock the dead bolt lever and thereby said dead bolt in its projecting position. Advantageously, the locking member is formed by a transverse pin extending through the dead bolt lever and having a first end cooperating with said first catch and said second catch, which transverse pin further has a second end, opposite the first end, cooperating with said further first catch and said further second catch.

By providing two sets of catches on opposite faces of the lock, possible effects of torque, for example generated by the action of a rotary driving bit on the locking member, which locking member is centrally connected to the dead bolt lever, are alleviated as the locking member is guided at two distinct locations. This is especially the case when the end regions of the locking member are cooperating with the catches.

In an embodiment of the disclosure, said first catch and said second catch is formed by a slot in the frame. Preferably, said slot comprises a portion, which is preferably substantially circularly shaped, and which connects said first catch and said second catch. It has been found that such a slot aids in guiding the locking member, especially during rotation of the dead bolt lever.

In an embodiment of the disclosure, said dead bolt is guided in the frame by at least two openings therein which are coaxially aligned such that said dead bolt in its retracted position projects at least 3 cm from said lock.

By guiding the dead bolt through two coaxially aligned openings in the frame, a sufficiently strong mounting mechanism between the dead bolt and the frame is provided in order to withstand the increased forces that the dead bolt may be subjected to when it is fully extended in case the dead bolt is designed to extend entirely through the post as with the locks disclosed in EP-B-1118739 and EP-B-2915939.

According to a first aspect of the disclosure, there is provided a lock for a hinged closure member. The lock comprises: a frame having a front plate; a dead bolt slidably mounted on the frame between a retracted position and a projecting position, which dead bolt protrudes through said front plate out of the lock; a dead bolt lever which engages the dead bolt and which is pivotally mounted on the frame between a first angular position, wherein the dead bolt is in its retracted position, and a second angular position, wherein the dead bolt is in its projecting position; a latch bolt slidably mounted on the frame between a retracted position and a projecting position and urged to its projecting position by a latch bolt spring, which latch bolt protrudes through said front plate out of the lock; a second turn latch bolt lever pivotally mounted on the frame and cooperating with the latch bolt to move the latch bolt from its projecting position to its retracted position against the latch bolt spring upon rotation in a first rotational direction; a second turn latch bolt driver having a distal end which is pivotally mounted on said second turn latch bolt lever and a proximal end which is slidably connected to the dead bolt lever, the proximal end of the second turn latch bolt driver having reciprocal movement in at least a first direction and in a second direction wherein it moves substantially away from and towards said front plate, the second turn latch bolt driver being arranged to rotate the second turn latch bolt lever in said first rotational direction when being moved in said first direction substantially along said front plate; and mounting means provided for mounting a key actuated cylinder on the frame, the key actuated cylinder being provided with a rotary driving bit rotatable upon actuation of said key actuated cylinder and having a free extremity arranged to travel along a circular path along a locking direction and an unlocking direction, opposite to said locking direction, upon actuation of said key actuated cylinder, the rotary driving bit being arranged to be rotated in said unlocking direction to act upon a first actuation element provided on the dead bolt lever to pivot the dead bolt lever from its second into its first angular position and to be rotated in said locking direction to act upon a second actuation element provided on the dead bolt lever to pivot the dead bolt lever from its first into its second angular position. The second turn latch bolt driver comprises a second turn actuation portion, the rotary driving bit being further arranged to, when said rotary driving bit is rotated in said unlocking direction with the dead bolt lever in its first angular position, act upon said second turn actuation portion to move the second turn latch bolt driver in said first direction to rotate the second turn latch bolt lever in said first rotational direction. The lock further comprises a spring acting upon the second turn latch bolt driver to urge the second turn actuation portion in said second direction towards said circular path of said free extremity. The second turn latch bolt driver further comprises a follower portion, the rotary driving bit being further arranged to, when said rotary driving bit has passed said second actuation element in said locking direction without the dead bolt lever being moved into said second angular position and when the rotary driving bit is rotated further in said locking direction, engage said follower portion to move the second turn actuation portion in said second direction out of said circular path against said spring.

This lock provides an alternative, with respect to EP-B-2915939, way to improve the reliability of the lock disclosed in EP-B-1118739. Specifically, by having the follower portion arranged to move the second turn actuation portion in said second direction out of the circular path of the rotary driving bit, the lock can never get blocked in a position wherein the dead bolt is not in the projecting position and the rotary driving bit has passed the second actuation element or in a position wherein the dead bolt is in its retracted position when the rotary driving bit has passed the second turn actuation portion. If the lock gets in the latter position in the embodiment of the disclosure, the rotary driving bit can be rotated in the locking direction to engage the follower portion of the second turn latch bolt driver to move the second turn actuation portion out of the path of the free extremity of the rotary driving bit, thereby releasing the rotary driving bit from its blocked position. Upon further rotation in the locking direction, the rotary driving bit will reengage with the dead bolt lever, while, upon rotation in the unlocking direction, the rotary driving bit will reengage with the second turn actuation portion.

In an embodiment of the disclosure, the slidable connection between the proximal end of the second turn latch bolt driver and the dead bolt lever comprises a protrusion cooperating with a slot. Preferably, the slot is L-shaped.

A protrusion-slot connection is easy to manufacture, reliable and compact. Moreover, the L-shape of the slot limits undesired motions of the second turn latch bolt driver and the dead bolt lever with respect to one another as much as possible.

As an example of the protrusion-slot connection, the slot is provided on the proximal end of the second turn latch bolt driver and the protrusion is provided on the dead bolt lever.

In a preferred embodiment of the disclosure, when the dead bolt lever is rotated from its first angular position to its second angular position, the protrusion urges against a side of the slot to move the second turn latch bolt driver, against said spring, out of the circular path of the rotary driving bit.

Consequently, when the lock is closed, actuation of the cylinder cannot result in contact with the second turn latch bolt driver. There is thus no risk of operating the latch bolt with the key actuated cylinder as long as the dead bolt remains in its projecting position.

In an embodiment of the disclosure, said spring is fixed on one end to the proximal end of the second turn latch bolt driver and on the other end to the frame.

In an embodiment of the disclosure, said first rotational direction is the same as said unlocking direction.

In an embodiment of the disclosure, the second turn latch bolt driver comprises a protrusion having a front face and an end face, said follower portion being formed by the front face and said second turn actuation portion being formed by the end face.

By having a protrusion performing a double functionality, a compact structure is obtained.

In an embodiment of the disclosure, the lock comprises further mounting means provided for mounting a further key actuated cylinder on the frame, the further mounting means being provided on an opposite face of the lock with respect to the mounting means, the further key actuated cylinder being provided with a further rotary driving bit rotatable upon actuation of said further key actuated cylinder and having a further free extremity arranged to travel along a further circular path along the locking direction and the unlocking direction upon actuation of said further key actuated cylinder, the further rotary driving bit being arranged to be rotated in said unlocking direction to act upon a further first actuation element provided on the dead bolt lever to pivot the dead bolt lever from its second into its first angular position and to be rotated in said locking direction to act upon a further second actuation element provided on the dead bolt lever to pivot the dead bolt lever from its first into its second angular position, wherein the second turn latch bolt driver comprises a further second turn actuation portion, the further rotary driving bit being further arranged to, when said rotary driving bit is rotated in said unlocking direction with the dead bolt lever in its first angular position, act upon said further second turn actuation portion to move the second turn latch bolt driver in said first direction to rotate the second turn latch bolt lever in said first rotational direction, and wherein said second turn latch bolt driver further comprises a further follower portion, the further rotary driving bit being further arranged to, when said further rotary driving bit has passed said further second actuation element in said locking direction without the dead bolt lever being moved into said second angular position and when the further rotary driving bit is rotated further in said locking direction, engage said further follower portion to move the further second turn actuation portion in said second direction out of said further circular path against said spring.

In this embodiment, measures have been taken to prevent either one of the rotary driving bits becoming blocked. In particular, the further rotary driving bit can be rotated in the locking direction to engage the further follower portion of the second turn latch bolt driver to move the further second turn actuation portion out of the path of the free extremity of the further rotary driving bit, thereby releasing the further rotary driving bit from its blocked position. Upon further rotation in the locking direction, the further rotary driving bit will reengage with the dead bolt lever, while, upon rotation in the unlocking direction, the further rotary driving bit will reengage with the further second turn actuation portion.

In a preferred embodiment of the disclosure, the second turn actuation portion and the follower portion are formed on a first part of the second turn latch bolt driver and the further second turn actuation portion and the further follower portion are formed on a second part of the second turn latch bolt driver, said first part and said second part being located on opposite sides of the dead bolt lever and being connected with a transverse connection. Preferably, said spring is fixed on one end to said transverse connection and on the other end to the frame.

As such, the dead bolt lever is relatively free to between the two parts of the second turn latch bolt driver. Moreover, the spring can be centrally placed with respect to both parts of the second turn latch bolt driver.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

Modes for Carrying Out the Disclosure

Figure 1:
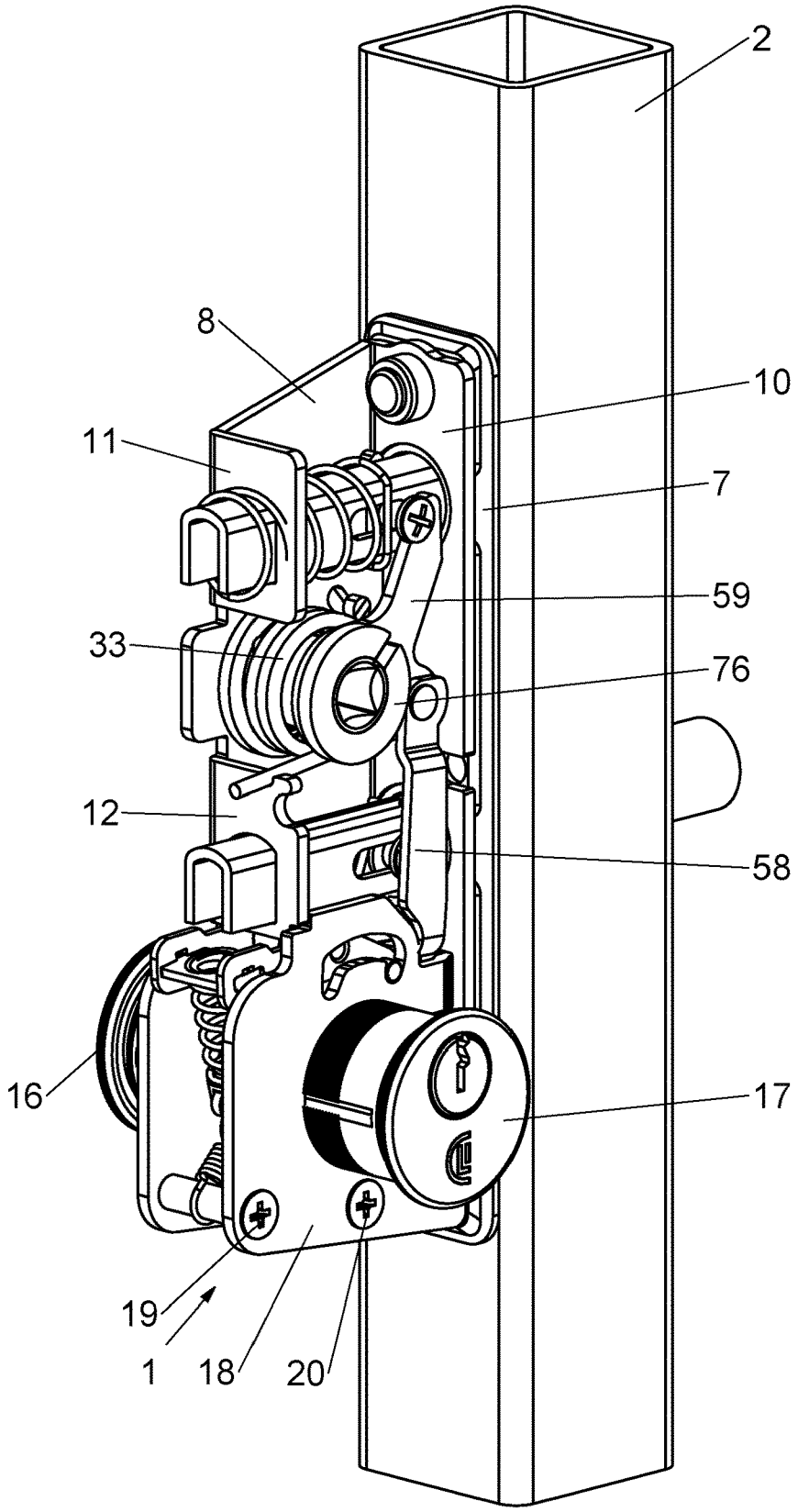
FIG. 1 shows the interior of a lock according to an embodiment of the disclosure mounted on a gate.

Throughout this disclosure, the preferred embodiments herein and examples illustrated are provided as examples, rather than as limitations on the scope of the present disclosure. As used herein, the terms "disclosure," "method," "present method" or "present disclosure" refers to any one of the embodiments incorporating features of the disclosure described herein, and any equivalents. Furthermore, reference to various feature(s) of the "disclosure," "method," "present method" or "present disclosure" throughout this document does not mean that all claimed embodiments or methods must include the referenced feature(s).

It is also understood that when an element or feature is referred to as being "on" or "adjacent" another element or feature, it can be directly on or adjacent the other element or feature or intervening elements or features that may also be present. Furthermore, relative terms such as "outer", "above", "lower", "below", and similar terms, may be used herein to describe a relationship of one feature to another. It is understood that these terms are intended to encompass different directions in addition to the direction depicted in the figures.

Although the terms first, second, etc. may be used herein to describe various elements or components, these elements or components should not be limited by these terms. These terms are only used to distinguish one element or component from another element or component. The terms are interchangeable under appropriate circumstances and the embodiments of the disclosure can operate in other sequences than described or illustrated herein. As used herein, the term "and/or" includes any and all combinations of one or more of the associated list items.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

The present disclosure will be described with respect to particular embodiments and with reference to certain drawings but the disclosure is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the disclosure.

FIG. 1 shows a lock 1 according to an embodiment of the disclosure. In the illustrated embodiment, the lock 1 is mounted against a profile 2 of a hinged closure member, specifically against a tubular profile of a gate or fence. The profile 2 is provided with holes (not shown) to receive both the latch bolt 5 and the dead bolt 6 there through. In an alternative, non-illustrated embodiment, the lock 1 may be used as a mortise lock and be put into a corresponding mortise in a door which then acts as the hinged closure member.

As used herein, the term "the latch bolt and/or dead bolt is/are in a retracted position" does not necessarily mean that the bolt is retracted within the lock 1 (i.e. meaning behind the front plate 7 of the lock 1). Instead, when the lock 1 is mounted on a tubular profile 2 as shown in FIG. 1, the term "the latch bolt and/or dead bolt is/are in a retracted position" means that the bolt is retracted in the corresponding hole of the tubular profile 2 where it is fixed against or that it extends over a small distance out of this profile 2. On the other hand, when the lock 1 is mounted in a mortise in a door, the term "the latch bolt and/or dead bolt is/are in a retracted position" means that the bolt is retracted within the lock 1, i.e. behind or at the same level as the front plate 7 of the lock 1.

As used herein, the term "the latch bolt and/or dead bolt is/are in a projecting position" means, in case the lock 1 is mounted on a tubular profile 2 as shown in FIG. 1, that the bolt extends over a larger distance out of the profile 2 where it is fixed against. On the other hand, when the lock 1 is mounted in a mortise in a door, the term "the latch bolt and/or dead bolt is/are in a projecting position" means that the bolt is projecting a certain distance from the lock 1, i.e. projecting from the front plate 7 of the lock. The distance over which the bolt moves between its projecting and retracted positions is called the stroke of the bolt.

Figure 2:
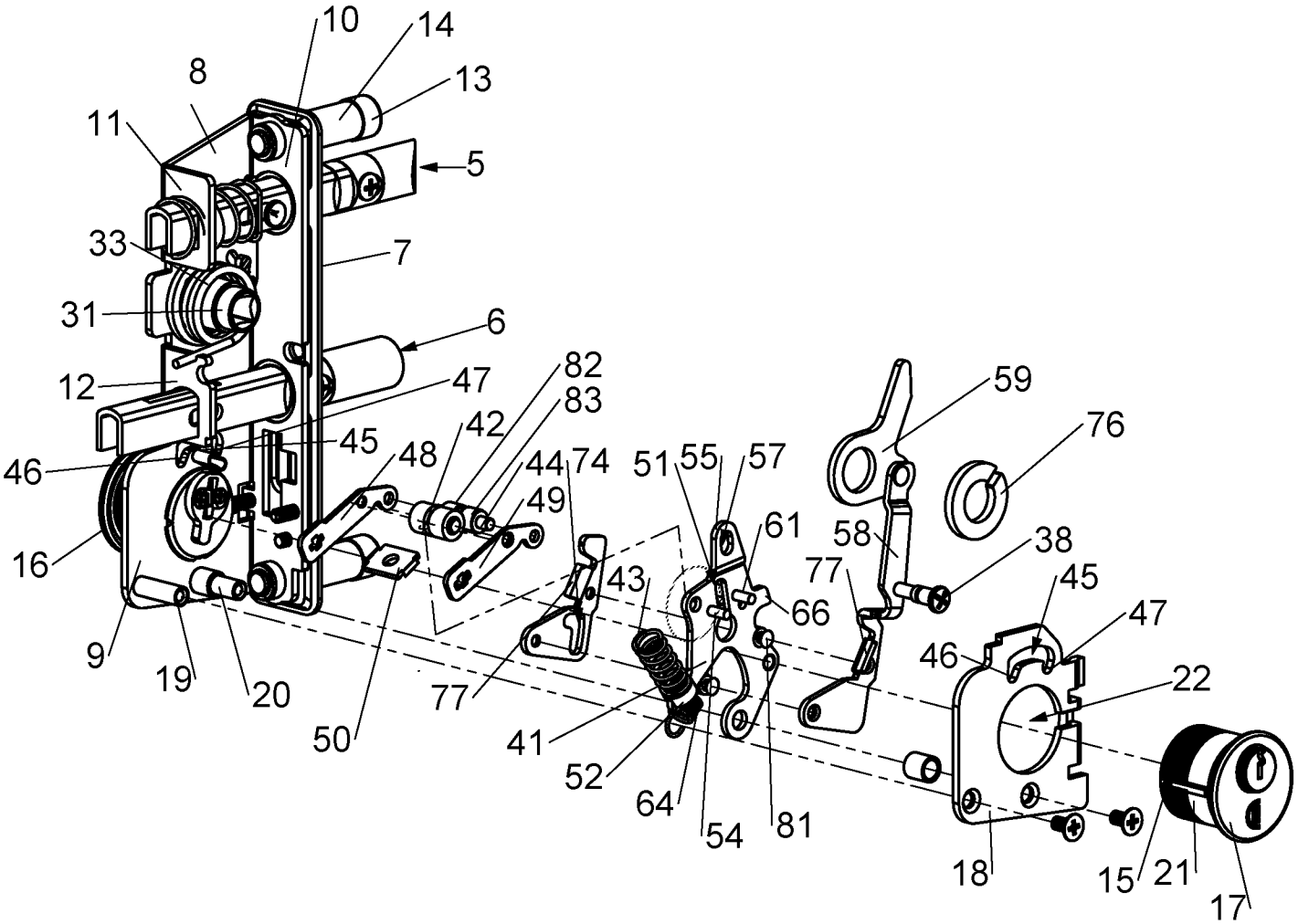
FIG. 2 shows an exploded view of certain inner parts of the lock illustrated in FIG. 1 and of a portion of the tubular profile of a gate onto which the lock is mounted.

A partly exploded view of the lock 1 of the embodiment of FIG. 1 is shown in FIG. 2. The lock 1 comprises a frame 8 including a base plate 9, a front plate 7 connected to the base plate 9 and a lower plate 18 connected to the base plate 9. When mounting the assembly of the base plate 9, the front plate 7 and the lower plate 18 in a cover box (not shown), the front plate 7 engages against the peripheral edge of the cover box. The base plate 9 has on its front side an upstanding edge 10 and on its back side two upstanding edge portions 11 and 12. The front plate 7 is connected to the base plate 9 by connecting the front plate 7 to the upstanding edge 10 of the base plate 9. Two threaded inserts are connected to corresponding holes in the upstanding edge 10 and the front plate 7. The bottom plate 18 is connected to the base plate 9 by means of two transverse screw connections 19, 20 and by a threaded insert in a corresponding opening in the upstanding edge 10. Screws 13 and spacers 14 are provided to fix the lock laterally to the profile 2 of the hinged closure member as illustrated in FIG. 1.

In the illustrated embodiments, the lock 1 is provided with two key actuated cylinders 16, 17 on opposite faces of the lock 1, each cylinder 16, 17 being mounted on the frame 8 by means of a threaded connection. Specifically, the first cylinder 16 is provided with a threaded outer surface that is mounted in an inner-threaded opening in the base plate 9, which inner-threaded opening is provided with an inner threaded surface to match the threaded outer surface of the first cylinder 16. Similarly, the second cylinder 17 is provided with a threaded outer surface 21 that is mounted in an inner-threaded opening 22 in the bottom plate 18, which inner-threaded opening 22 is provided with an inner threaded surface to match the threaded outer surface 21 of the second cylinder 17. The bottom plate 18 thus acts as a cylinder support member for the second cylinder 17. Each of the cylinders 16, 17 is also provided with one or more grooves 15 in its outer surface, which grooves 15 are used to lock the cylinder with respect to the frame 8 by means of a threaded insert (not shown). Such cylinders 16, 17 are commercially available, for example the "1 inch Mortise Cylinder" sold by "All About Doors and Windows". In an advantageous embodiment, the second threaded insert which locks the second cylinder 17 to the bottom plate 18 may also be used be part of the connection between the bottom plate 18 and the base plate 9.

In an alternative, non-illustrated embodiment, only a single key actuated cylinder 16 is used. This may be the case, for example, when only one face of the lock 1 is required to be actuated by a key. Alternatively, the single key actuated cylinder 16 is a cylinder which extends through the lock 1 and is thus also accessible from both faces of the lock 1. An example of such a cylinder is a so-called Euro-cylinder corresponding to standard DIN 18252/2006 which is secured to the frame 8 by means of a threaded insert. In this embodiment, the openings in the base plate 9 and the bottom plate 18 do not require a threaded inner surface.

Irrespective of the number of key actuated cylinders, each of these comprises a rotary driving bit 25 which may be rotated around a central axis of the respective cylinder to actuate the lock 1 as described below. Specifically, each rotary driving bit 25 may be rotated in either a locking direction (clockwise in FIGS. 3 to 11) or an unlocking direction (counter clockwise in FIGS. 3 to 11). Each rotary driving bit 25 has a free extremity 23 (indicated in FIG. 6) which, upon actuation of the rotary driving bit, travels along a circular path 26 (indicated by the dashed line in FIG. 3) in either the locking or unlocking direction.

The lock 1 further comprises a latch bolt 5 which is slidably mounted in the frame 8 by moving in a first corresponding opening in the upstanding edge portion 11 and in a second corresponding opening in the upstanding edge 10 and/or in the front plate 7. A compression spring 27 is provided over the latch bolt 5 to urge this bolt to its projecting position (shown in FIG. 3). The compression spring 27 is acting between the upstanding edge portion 11 and slide means 28, e.g. a screw or pin, on the latch bolt 5.

The latch bolt 5 may be actuated by means of handles (not shown) to its retracted position to open the hinged closure member. Specifically, a rectangular shaft of the handles is inserted in a corresponding rectangular hole 30 in a follower 31 (indicated in FIG. 2). This follower 31 is in turn connected to a latch bolt lever 32 which follows the rotation of the handles. The handles are thus used to move the latch bolt lever 32 against the action of a main spring 33 which is a spiral spring positioned around the follower 31. The main spring 33 pushes the latch bolt lever 32 and thus the follower 31 and the handles to their rest positions. A free extremity of the latch bolt lever 32 engages the slide means 28 on the latch bolt 5. Consequently, actuation of the handles causes the follower 31 to rotate the latch bolt lever 32 against the action of the main spring 33 while the free extremity of the latch bolt lever acts upon the slide means 28 on the latch bolt 5 to move the latch bolt 5 against the compression spring 27 into its retracted position (shown in FIG. 7).

The latch bolt 5 in the embodiment of the FIGURES is made of steel, more particularly of stainless steel which is a strong and weather resistant material but is difficult to be shaped in the usual way, e.g. by milling. As will become apparent hereinafter, the latch bolt 5 may indeed have quite a complex shape, especially in order to allow adjusting the length over which it projects out of the lock 1. The latch bolt 5 has two separate parts, namely a hollow part 34 and a more solid bolt part 35. The solid bolt part 35 is arranged to project out of the lock 1 into a corresponding lock catcher, preferably a lock catcher as described in EP-A-3239440 which is incorporated in its entirety herein by reference.

In the illustrated embodiments, the solid part 35 is removably mounted into the hollow rod part 34. In this way, the solid part 35 can be mounted in two positions, namely in a first position wherein the oblique front face is directed in a first direction and in a second position wherein the oblique front face is rotated axially over about 180°. The latch bolt 5 illustrated in the FIGURES as well as an alternative latch bolt is described in EP-B-1118739 which is incorporated in its entirety herein by reference.

Figure 6:
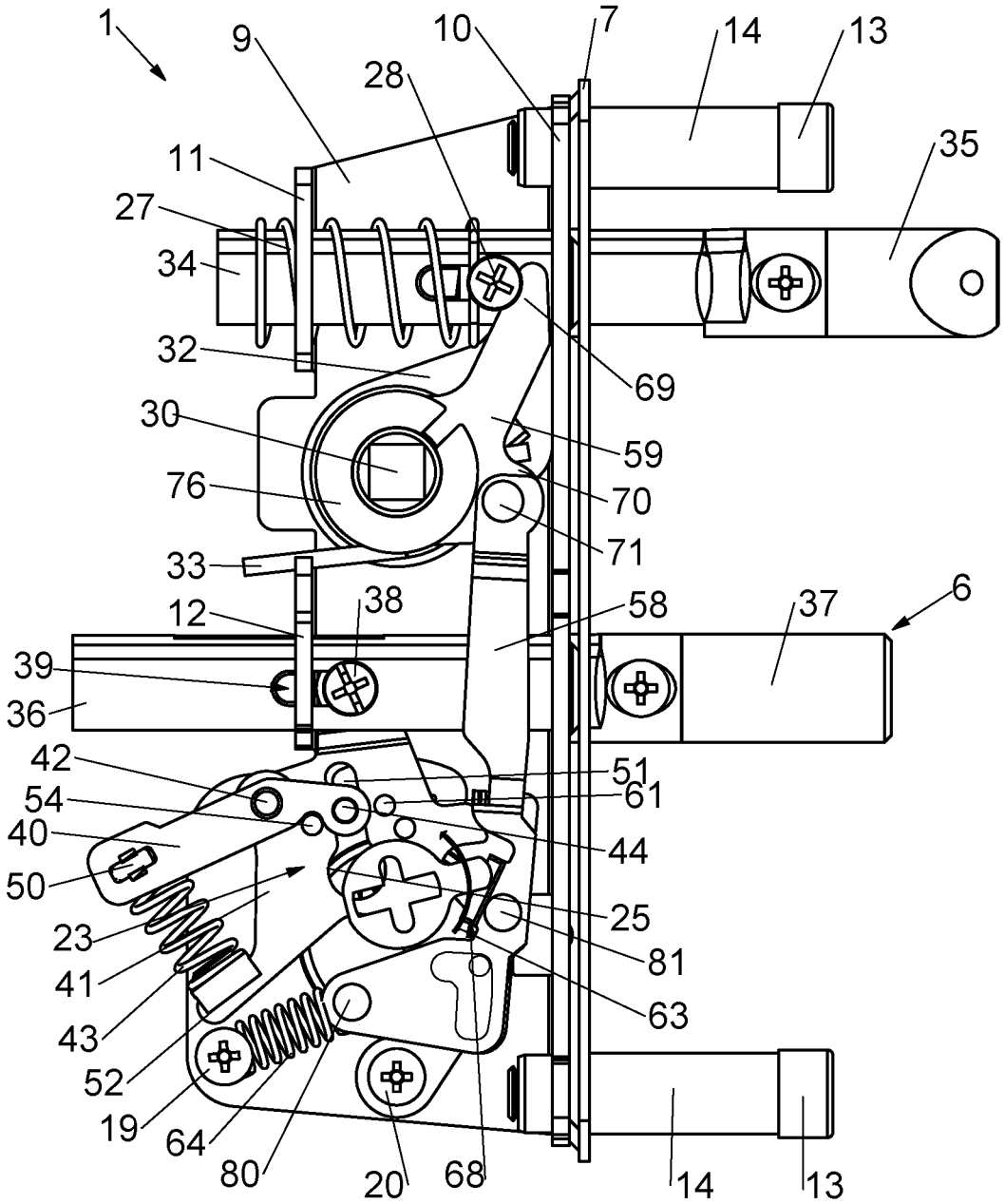
FIG. 6 shows the side view of the embodiment of FIG. 5 with the dead bolt in its retracted position after having turned the rotary driving bit further in the unlocking direction.

The lock further comprises a dead bolt 6 which is slidably mounted on the frame 8 between a projecting position (shown in FIG. 3) and a retracted position (shown in FIG. 6). The dead bolt 6 slides in corresponding openings in the upstanding edge 10 and the upstanding edge portion 12 of the base plate 9. The dead bolt 6 is locked in both positions, i.e. the projecting position and the retracted position, by a locking mechanism that is operable by either one of the key actuated cylinders 16, 17.

In the embodiment illustrated in the FIGURES, the dead bolt 6 is made of two portions: a hollow rod part 36 and a bolt part 37. The hollow rod part 36 extends at least partially in the lock 1. The bolt part 37 is arranged to cooperate with the lock catcher as described above. In the rod part 36, slide means 38 are arranged which are guided in slots 39 in the rod part 36 of the dead bolt 6. The position of the slide means 38 relative to the rod part 36 can be adjusted by means of a known technology, e.g. a set screw (not shown) in the length direction of the rod part 36 and accessible through an axial passageway in the bolt parts 36 and 37. In this way, the distance over which the dead bolt 6 projects out of the lock 1 can be adjusted.

According to one aspect of the disclosure, the locking mechanism comprises a spring biased lever 40 pivotally mounted on a dead bolt lever 41 which engages the dead bolt 6 as described below. The spring biased lever 40 pivots around pivot 42 which may be formed by protrusions on the dead bolt lever 41. A first end of the lever 40 is connected to one end of a spring 43, in particular a compression spring, the opposing end of the spring 43 being fixed to the dead bolt lever 41, in particular on a protrusion 52 thereof. A second end of the lever 40, on the opposite side of the pivot 42 as the first end of the lever 40, acts as locking member 44 and is urged, due to spring 43, towards the circular path 26 of the free extremity of the rotary driving bit 25. The locking mechanism further comprises two catches 46, 47, preferably formed by a single slot 45 in the frame 8. Preferably, the frame 8 comprises two sets of catches 46, 47, each set being preferably formed by a single slot 45, as illustrated in FIG. 2. In particular, a first one of the slots 45 is formed in the base plate 9, while a second of the slots is formed in the bottom plate 18. The locking member 44 is guided within the slot 45 and the spring 43 urges the locking member 44 into catch 46 when the dead bolt 6 is in its retracted position and into catch 47 when the dead bolt 6 is in its projecting position thus locking the dead bolt 6 in one of its two positions, i.e. the projecting position and the retracted position. The use of two slots 45 ensures that both sides of the locking member 44 are guided.

Because lever 40, with its locking member 44, is mounted on the dead bolt lever 41, urging the locking member 44 into one of the catches 46, 47 not only locks the dead bolt 6 in one of its two positions, i.e. the projecting position and the retracted position, but also locks the dead bolt lever 41 itself, i.e. the dead bolt lever 41 is prevented from being rotated around its pivot.

In a preferred embodiment, the lever 40 has two arms 48, 49 located on opposite sides of the dead bolt lever 41. The arms 48, 49 are connected on the first end of the lever 40 by a transverse plate 50 upon which the spring 43 acts. The arms 48, 49 are connected on the second end of the lever 40 by a transverse pin which forms the locking member 44, the ends of the pin being guided in slot(s) 45. As such, in this embodiment, the locking member 44 extends through the dead bolt lever 41, meaning that an opening 51 is provided in the dead bolt lever 41 to enable the locking member 44 to move with respect to the dead bolt lever 41. In the illustrated embodiments, washers 82, 83 are provided over the transverse pin 44 on either side of the dead bolt lever 41.

This preferred embodiment is particularly advantageous when the lock 1 comprises two key actuated cylinders 16, 17, since the first cylinder 16 acts on arm 48 while the second cylinder 17 acts on arm 49. Consequently, it is also advantageous to use two slots 45 in this embodiment.

The movement of the dead bolt 6 is controlled by actuating either one of the key actuated cylinders 16, 17 to cause a rotation of either one of the rotary driving bits 25, which rotation in turn actuates the dead bolt lever 41 which is pivotally mounted about a pivot formed by the second transverse screw 20 used to fix the lower plate 18 to the base plate 9. The dead bolt lever 41 may be rotated between a first angular position (shown in FIG. 6), corresponding to the retracted position of the dead bolt 6, and a second angular position (shown in FIG. 3), corresponding to the projecting position of the dead bolt 6.

Figure 4:
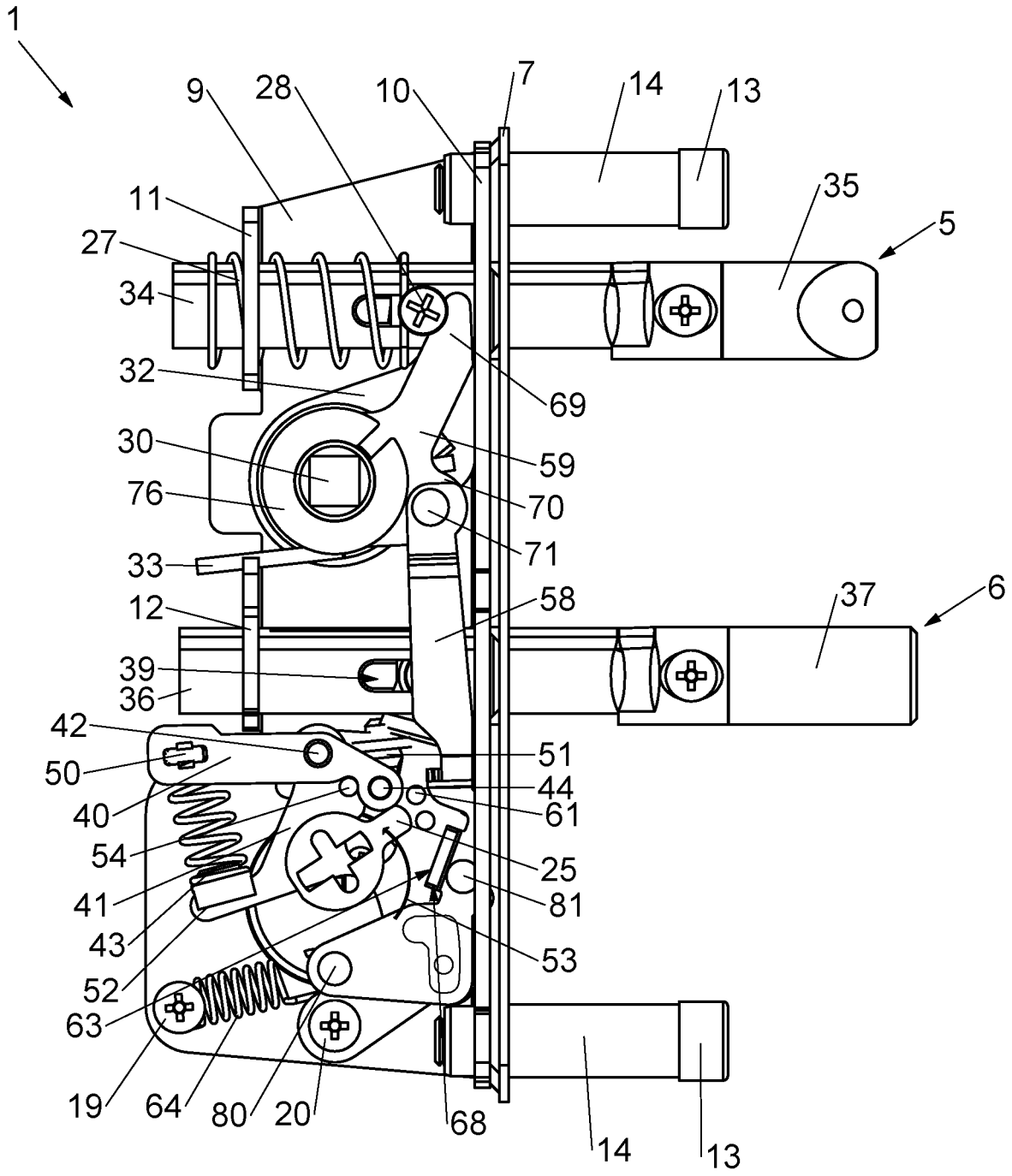
FIG. 4 shows a side view of the embodiment of FIG. 3 with the rotary driving bit having been turned in the unlocking direction into an engaging position with the locking member.

As illustrated in FIG. 4, when the dead bolt 6 is in the projecting position, movement of the rotary driving bit 25 in the locking (i.e. counter clockwise) direction (see arrow 53 on FIG. 4) results first in engagement of the rotary driving bit 25, in particular the free extremity 23 thereof, with the locking member 44 so that the locking member 44 is moved out of catch 47, i.e. out of the circular path 26 of the free extremity of the rotary driving bit 25, to unlock the dead bolt 6 from its projecting position. Simultaneously, movement of the locking member 44 out of catch 47 enables rotation of the dead bolt lever 41.

Figure 5:
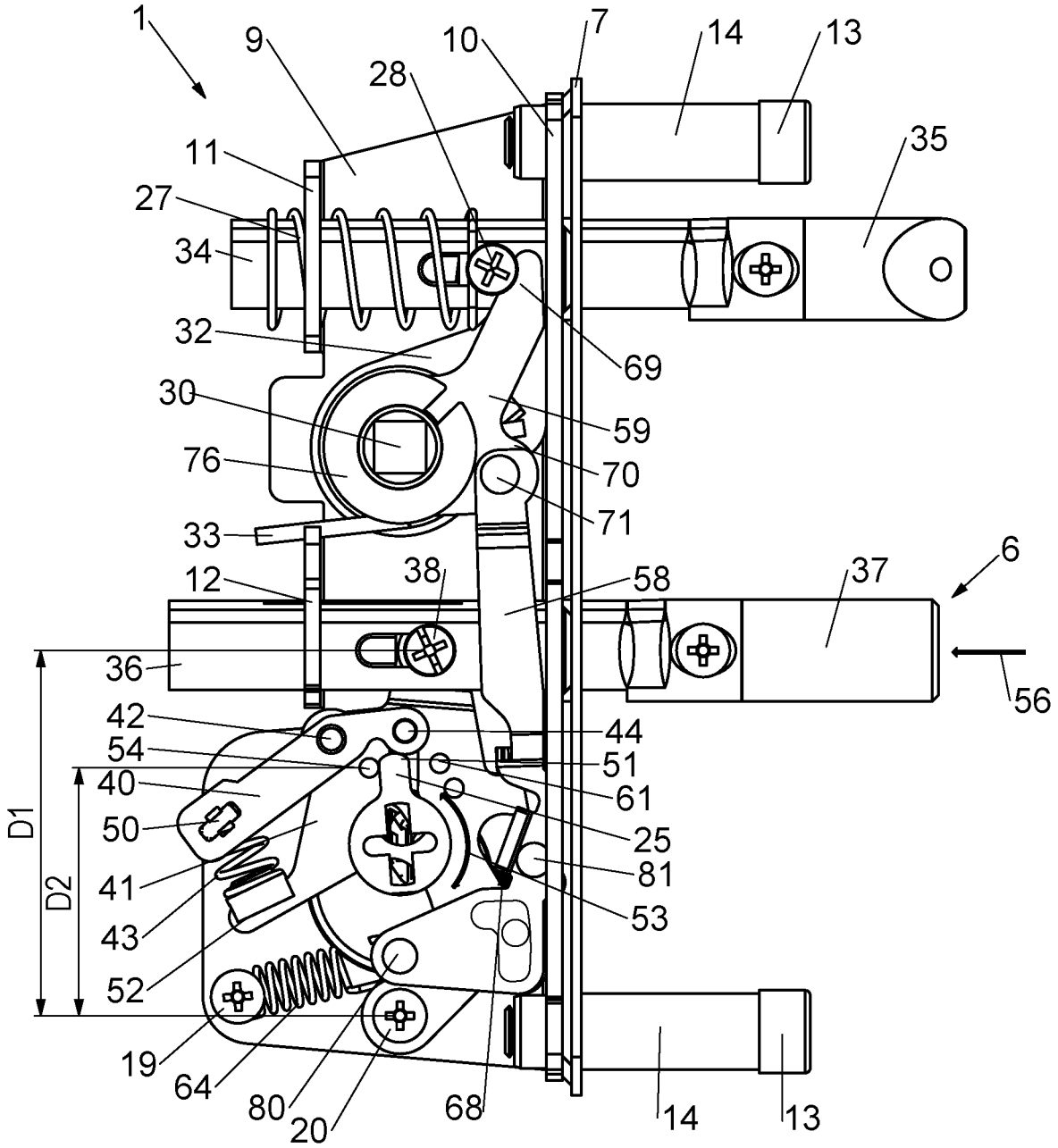
FIG. 5 shows the side view of the embodiment of FIG. 4 with the rotary driving bit having been turned further in the unlocking direction into an engaging position with the first actuation element of the dead bolt lever wherein the rotary driving bit has already pushed the locking member to its unlocking position to move the dead bolt from its projecting to its retracted position.

When subsequently the rotation in the unlocking direction 53 is continued as illustrated in FIG. 5, the rotary driving bit 25 engages a first actuation element 54 on the dead bolt lever 41, which element 54 is formed by a protrusion from the dead bolt lever 41. Preferably, the lock 1 comprises two first actuation elements 54, one on each side of the dead bolt lever 41, meaning that the rotary driving bit 25 of the respective cylinder 16, 17 has its own first actuation element 54.

The dead bolt lever 41 has a protrusion 55 that is connected to the dead bolt 6 such that a rotation of the dead bolt lever 41 about pivot 20 in the unlocking direction 53 results in a translation movement of the dead bolt 6 in the direction of arrow 56 (see FIG. 5). In particular, the protrusion 55 is provided on a first arm of the dead bolt lever 41, which first arm extends from the pivot 20 to the dead bolt 6. In the embodiment of FIGS. 4 to 6, the first arm of the dead bolt lever 41 is connected to the dead bolt 6 by providing a slot 57 in the dead bolt lever 41 with the slide means 38 being provided in the slot 57 of the dead bolt lever 41. As illustrated in FIG. 6, further rotation of the rotary driving bit 25 in the unlocking, counterclockwise direction 53 fully retracts the dead bolt 6. The spring 43 urges the locking member 44 into catch 46 thereby locking the dead bolt 6 in its retracted position and also the dead bolt lever 41 in its first angular position.

Further rotation of the rotary driving bit 25 in the unlocking direction 53 enables to retract the latch bolt 5 by means of a second turn latch bolt driver 58 and a second turn latch bolt lever 59, which will be described in more detail below.

Figure 7:
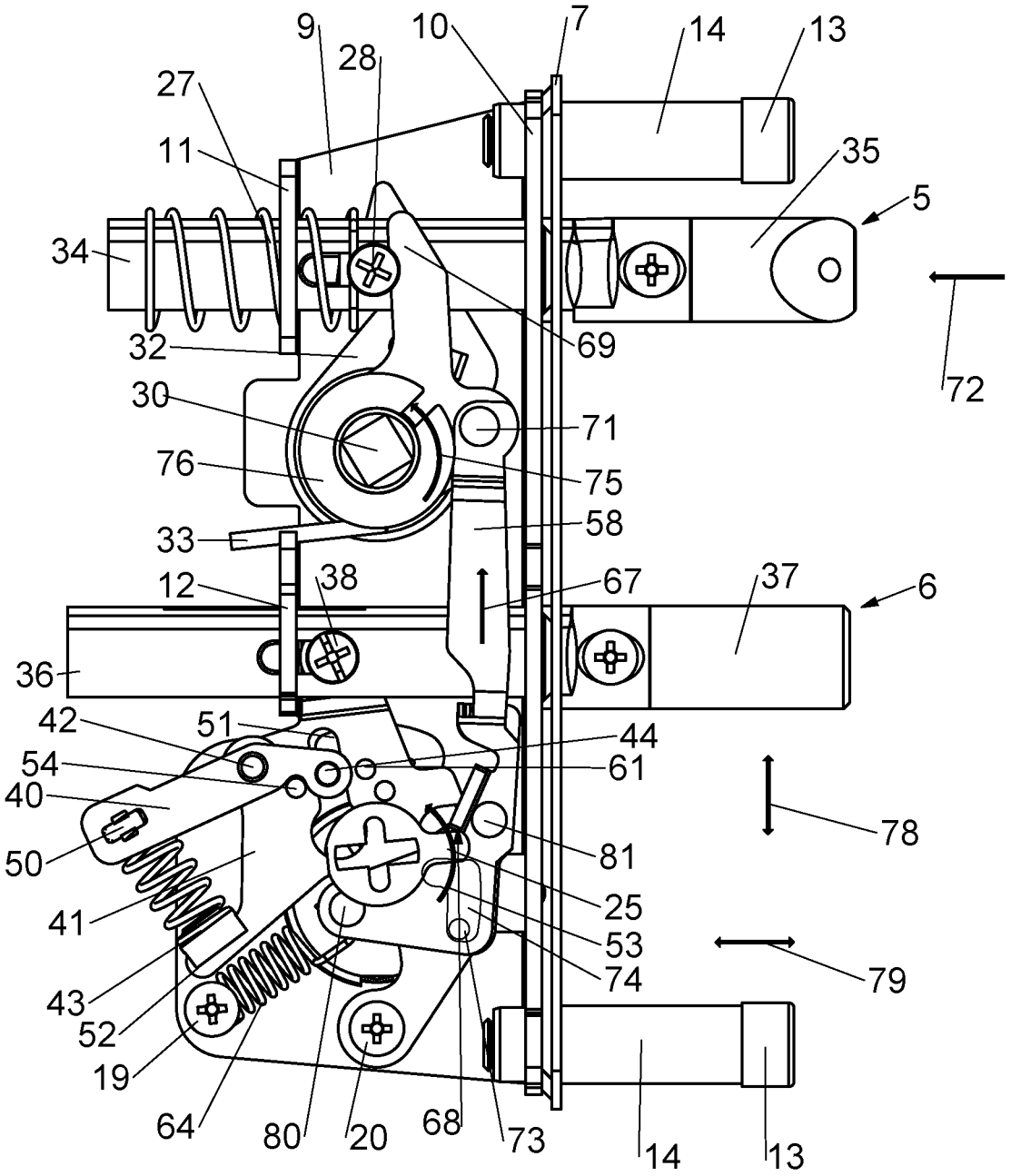
FIG. 7 is a same view as FIG. 6 but with the rotary driving bit rotated further in the unlocking direction to engage with the second turn actuation portion to move the second turn latch bolt driver along the first direction to rotate the second turn latch bolt lever in the first rotational direction to move the latch bolt into its retracted position.
Figure 8:
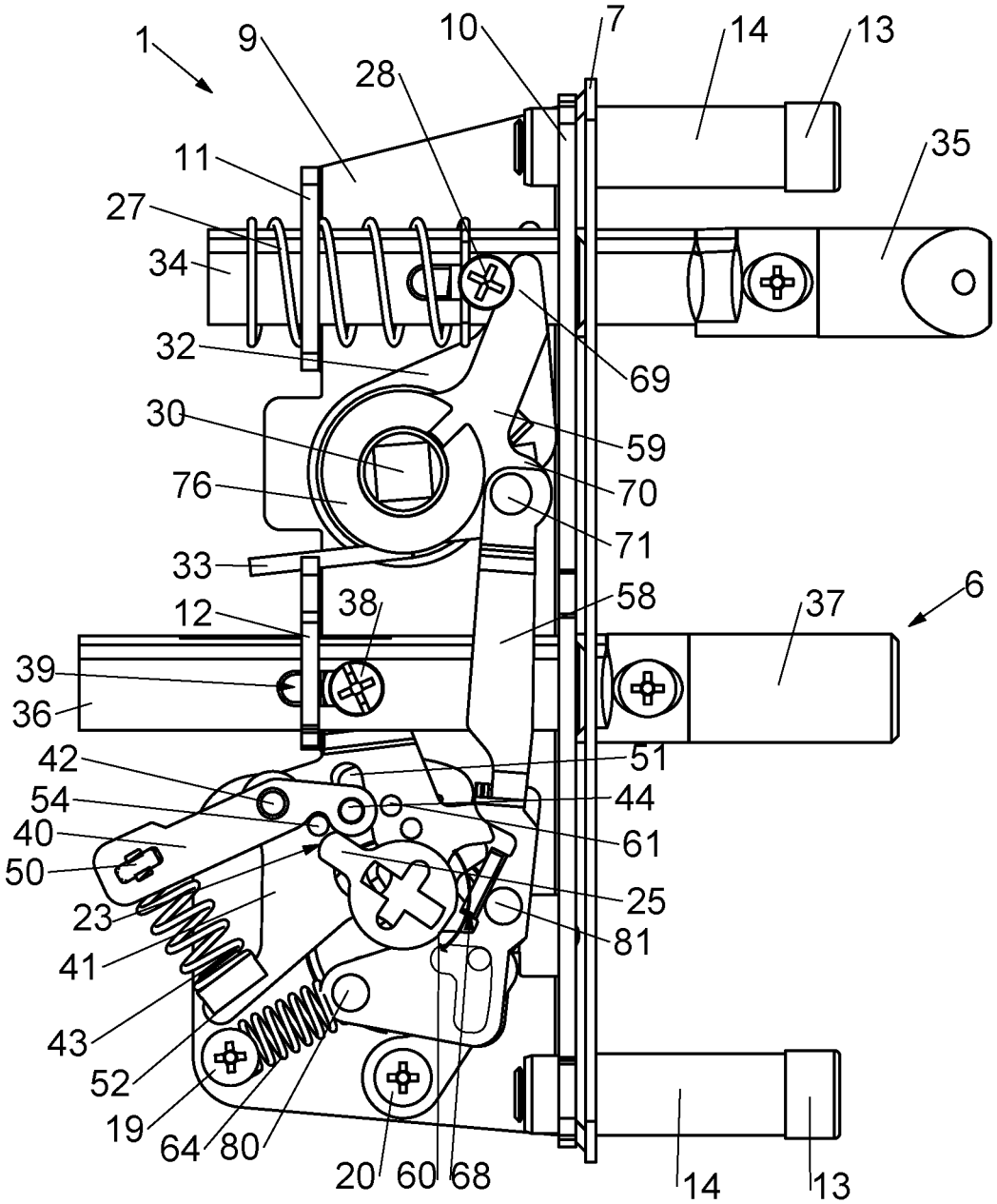
FIG. 8 shows the side view of the embodiment of FIG. 3 with the dead bolt in its retracted position with the rotary driving bit rotated in the locking direction into an engaging position with the locking member to unlock the dead bolt from its retracted position.

When the dead bolt 6 is in the retracted position (illustrated in FIG. 6) and the rotary driving bit 25 is rotated back in the locking (clockwise in FIGS. 3 to 11) direction (indicated with arrow 60 in FIG. 8) as illustrated in FIG. 8, the rotary driving bit 25, in particular the free extremity 23 thereof, engages the locking member 44 so that the locking member 44 is moved out of catch 46 and out of the circular path 26 of the free extremity of the rotary driving bit 25, to unlock the dead bolt 6 from its retracted position. Simultaneously, movement of the locking member 44 out of catch 46 enables rotation of the dead bolt lever 41 and further rotation of the rotary driving bit 25 in the locking direction.

Figure 9:
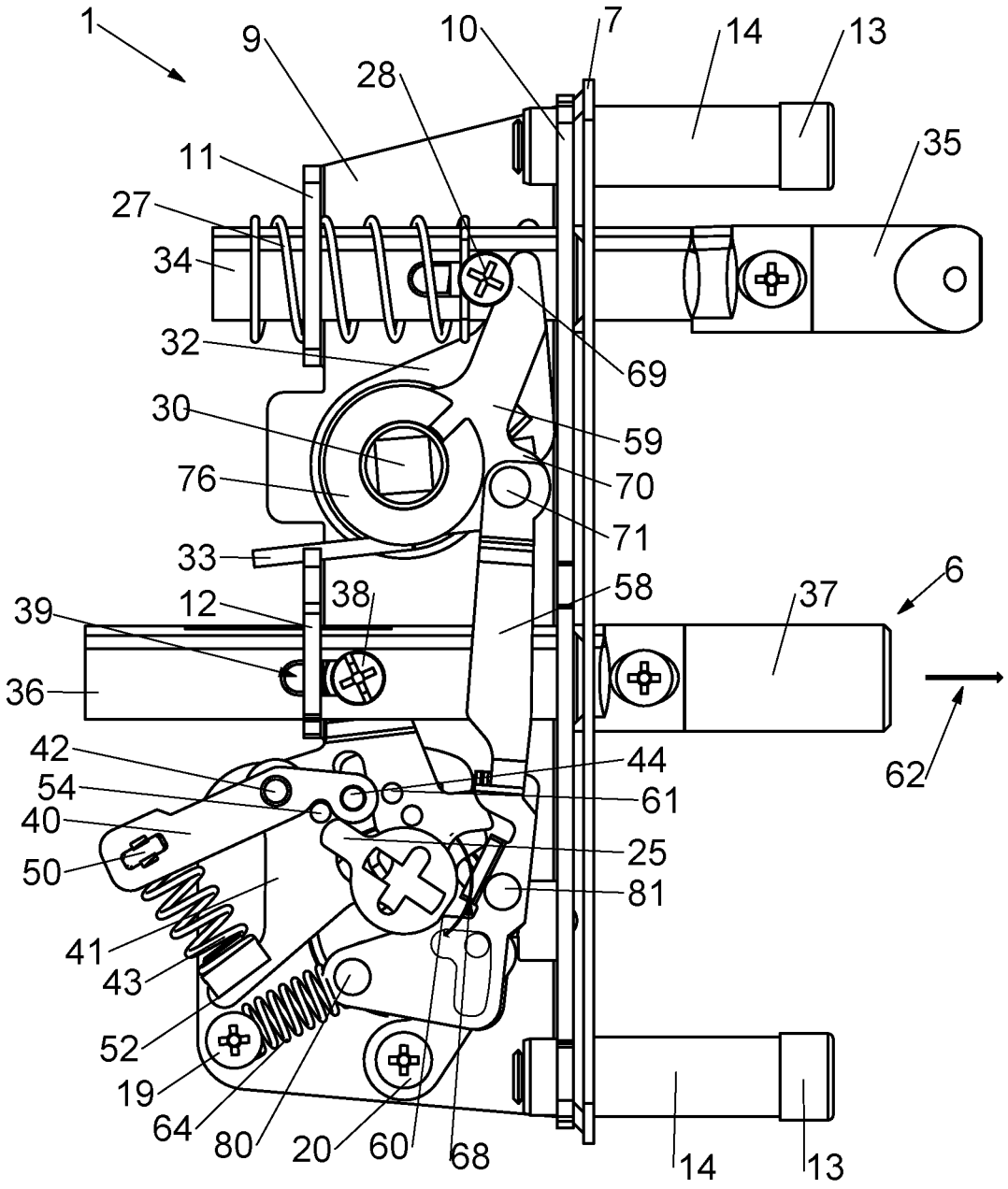
FIG. 9 shows the side view of the embodiment of FIG. 8 with the rotary driving bit having been rotated in the locking direction into an engaging position with the second actuation element of the dead bolt lever wherein the rotary driving bit has already pushed the locking member to its unlocking position to move the dead bolt from its retracted to its projecting position.

When subsequently the rotation in the locking direction 60 is continued as illustrated in FIG. 9, the rotary driving bit 25 engages a second actuation element 61 of the dead bolt lever 41. Because the dead bolt lever 41 is connected with the dead bolt 6 as described above, rotation of the dead bolt lever 41 in the locking direction 60 results in a translation movement of the dead bolt 6 in the direction of arrow 62 (see FIG. 9). Preferably, the lock 1 comprises two second actuation elements 61, one on each side of the dead bolt lever 41, meaning that the rotary driving bit 25 of the respective cylinder 16, 17 has its own second actuation element 61.

Further rotation of the rotary driving bit 25 in the locking, counterclockwise direction 60 fully projects the dead bolt 6. The spring 43 urges the locking member 44 into catch 47 thereby locking the dead bolt 6 in its projecting position and also the dead bolt lever 41 in its second angular position as shown in FIG. 3.

Figure 10:
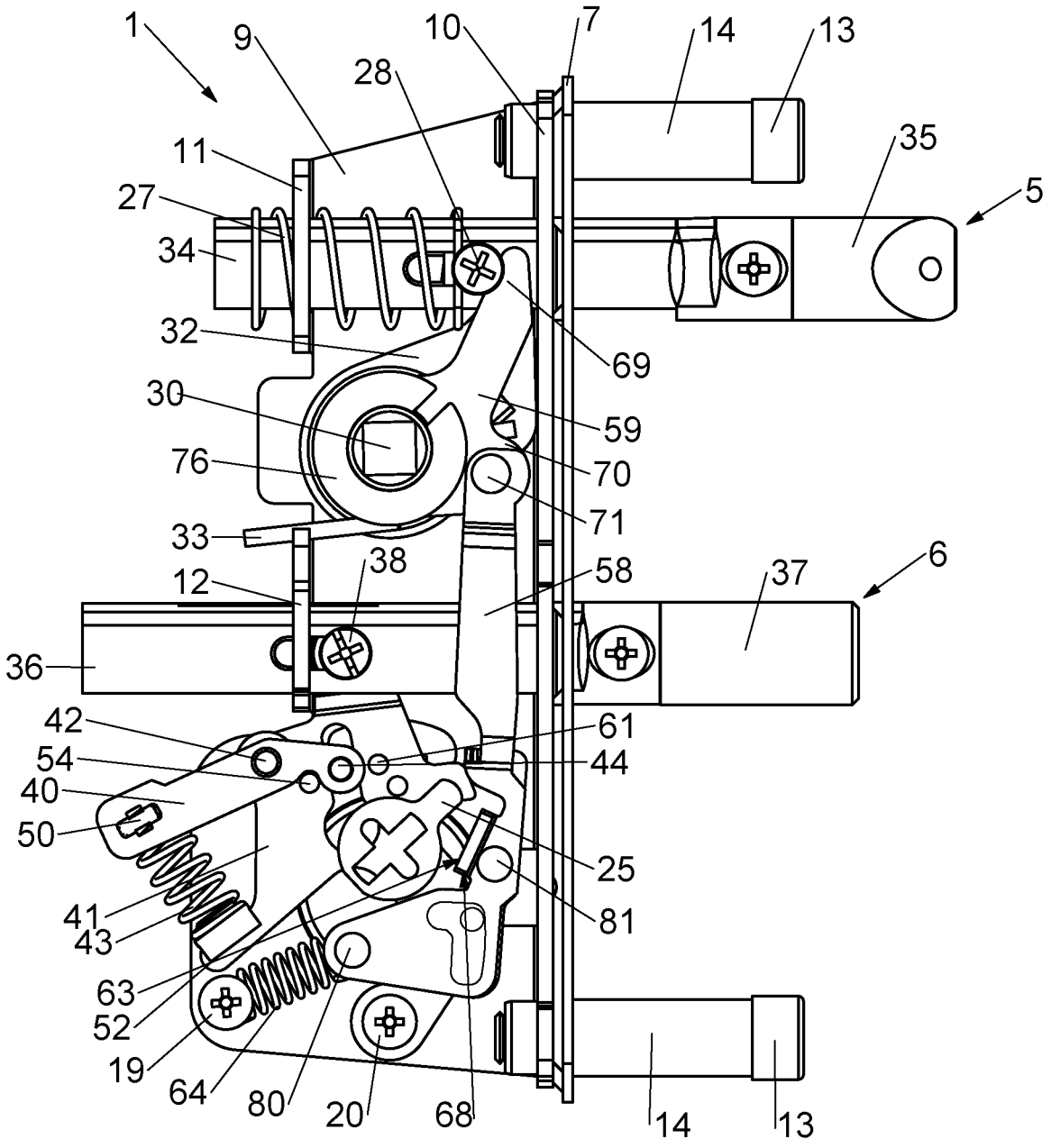
FIG. 10 shows the side view of FIG. 3 with the rotary driving bit having passed the second actuation element without having moved the dead bolt into its projecting position.

In some situations, especially when forces are acting on the dead bolt 6 in the opposite direction of the translation movement 62, the rotary driving bit 25 may pass the second actuation element 61 of the dead bolt lever 44 without the locking member 44 being urged into catch 47. In such a case, the dead bolt 6 may be moved somewhat back towards its retracted position and may be pushed further towards its retracted position when the rotary driving bit 25 is rotated in the unlocking direction and acts upon the second actuation element 61 (instead of on the first actuation element) so that the locking member 44 will be urged into catch 46. However, the rotary driving bit 25 is situated on the wrong side of the second actuation element 61 so that it cannot be rotated further in the unlocking direction. This situation is illustrated in FIG. 10 and it is an aspect of the disclosure to ensure that the rotary driving bit 25 is not permanently stuck in this position, i.e. by being blocked by the second actuation element 61 in the unlocking rotation direction and by being blocked by the second turn latch bolt driver 58 in the locking rotation direction.

Figure 11:
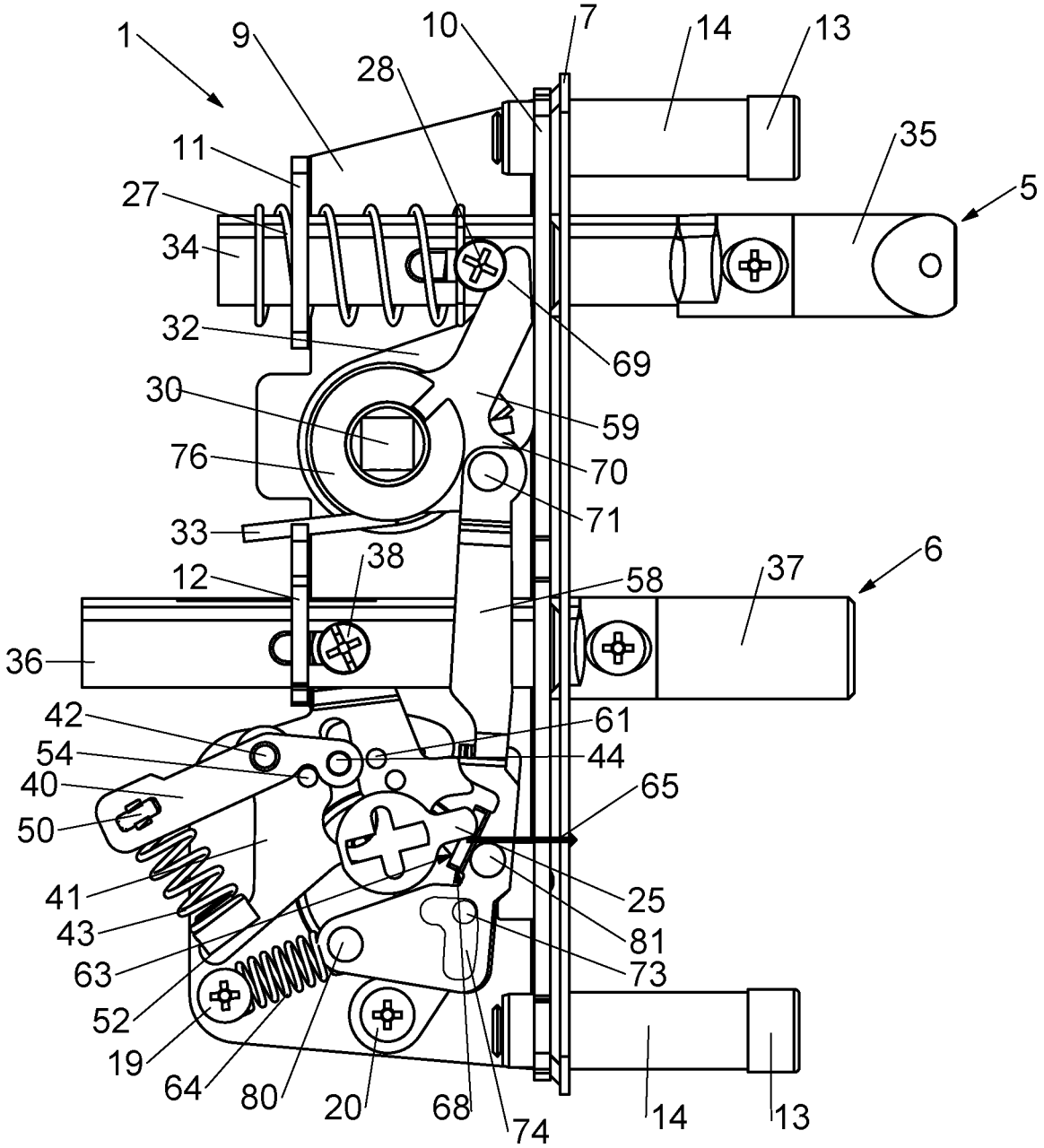
FIG. 11 shows the side view of FIG. 10 with the rotary driving bit being rotated further in the locking direction into engagement with the follower portion of the second turn latch bolt driver to move the second turn actuation portion out of the path of the free extremity of the rotary driving bit.

According to this aspect of the disclosure, as illustrated in FIG. 11, when the rotary driving bit 25 is further rotated in the locking direction 60, the rotary driving bit 25 engages a follower portion 63 on the second turn latch bolt driver 58. The follower portion 63 is formed by a surface of a protrusion 77 (indicated in FIG. 2) of the second turn latch bolt driver 58. This follower portion 63 is urged into the circular path 26 of the free extremity of the rotary driving bit 25 due to a spring 64 which is connected at its first end to the second turn latch bolt driver 58 and at its second end to the frame 8 via the first transverse screw connection 19 between the base plate 9 and the lower plate 18. Alternatively, the spring 64 at its second end may be connected to the dead bolt lever 41. Rotation of the rotary driving bit 25 in the locking direction pushes the follower portion 63 out of the circular path 25, i.e. the follower portion 63 moves towards the front plate 7 (see arrow 65 in FIG. 11). This outward, i.e. radially away from the circular path 26, allows the rotary driving bit 25 to pass by the follower portion 63 upon rotation of in the locking direction 60. Once passed the follower portion 63, the rotary driving bit 25 can be rotated further in the locking direction 60 until it re-engages with the locking member 44 as shown in FIG. 8 while the spring 64 urges the follower portion 63 back into the circular path 26.

Figure 3:
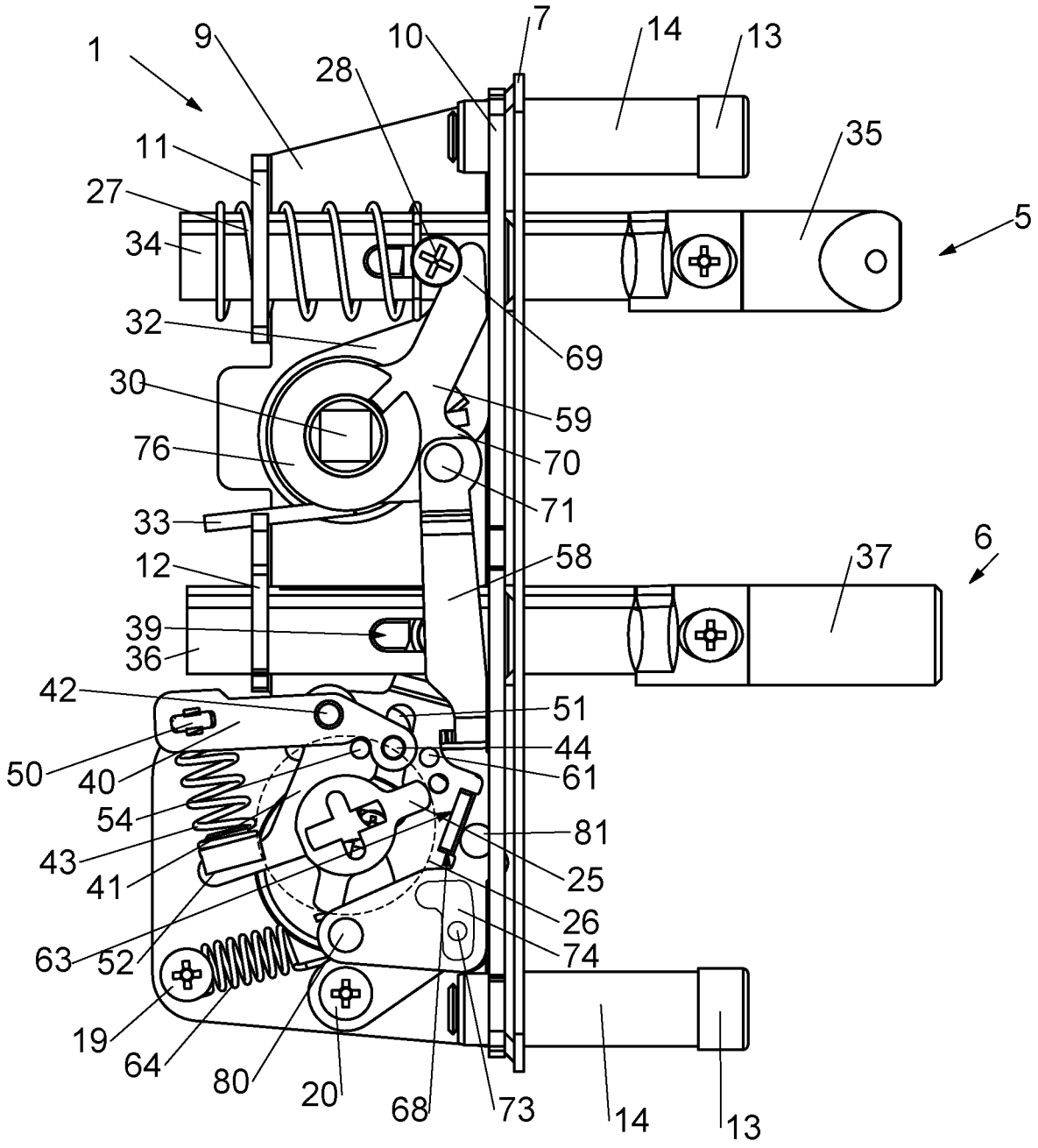
FIG. 3 shows a side view of the main inner parts of the lock as shown in FIGS. 1 and 2 in the projecting positions of the dead and latch bolt.

The dead bolt 6 has only two extreme positions (apart from the fact that the distance over which it projects out of the lock can be adjusted), namely a projecting position, illustrated in FIG. 3, and a retracted position, illustrated in FIG. 6. These two extreme positions correspond respectively to the second and the first angular positions of the dead bolt lever 41 as described above. In the second angular position of the dead bolt lever 41, a stop portion of the dead bolt lever 41, more particularly a projection 66 on the dead bolt lever 41, engages a stop on the frame 8, more particularly the front plate 7 (through a slot in the upstanding edge 10, which has not been shown), so that the dead bolt lever 41 cannot rotate any further.

In the illustrated embodiments, the cylinder(s) 16, 17 is/are provided between the dead bolt 6 and the pivot 20. The pivot 20 is so positioned that the dead bolt lever 41 engages the dead bolt 6 on a first distance from the pivot 20 and the rotary driving bit 25 engages the dead bolt lever 41 (meaning the first or second actuation element 54, 61) on a second distance from the pivot 20 with the second distance in each position of the dead bolt lever 41 being smaller than the first distance. This ensures an increased stroke of the dead bolt 6 as explained in EP-B-1118739.

Referring to FIG. 7, the lock 1 comprises a second turn latch bolt driver 58. The second turn latch bolt driver 58 is at its one end slidably connected to the dead bolt lever 41. The slidable connection between the dead bolt lever 41 and the second turn latch bolt driver 58 operates in two distinct directions. Specifically, a first direction (indicated with arrow 78 in FIG. 7) allowing the second turn latch bolt driver 58 to move substantially along the front plate 7 and a second direction (indicated with arrow 79 in FIG. 7) to move the second turn latch bolt driver 58 entirely out of the circular path 26 and at least partly into the circular path 26 by moving substantially away from and towards the front plate 7. As described above, the spring 64 already urges the second turn latch bolt driver 58 at least partly into the circular path 26, in particular the follower portion 63 thereof.

Specifically, in the first angular position of the dead bolt lever 41, i.e. in the position as illustrated in FIG. 7, wherein the dead bolt 6 is locked in its retracted position, a second turn actuation portion 68 of the second turn latch bolt driver 58 is in the circular path 26 of the free extremity 26 of the rotary driving bit 14. Consequently, upon rotation of the rotary driving bit 25 in the unlocking direction, with the dead bolt in its retracted position, the rotary driving bit 25 engages with the second turn actuation portion 68 of the second turn latch bolt driver 58 as shown in FIG. 7.

The second turn latch bolt driver 58 is at its other end connected to the second turn latch bolt lever 59 arranged to move the latch bolt 5 against the action of the compression spring 27 from its projecting position to its retracted position. The second turn latch bolt lever 59 is rotatable arranged over the follower 31 and is covered by a washer 76. The second turn latch bolt lever 59 has a first lever arm 69 to engage the sliding means 28 on the latch bolt 5 and a second lever arm 70 to pivotally connect with the second turn latch bolt driver 58 about pivot 71.

When in the position of FIG. 6, thus after moving the dead bolt 6 from the projecting to the retracted position by rotating the rotary driving bit 25 in the unlocking direction 53, further rotation of the rotary driving bit 25 in the unlocking direction 53 (i.e. a second turn in the unlocking direction) engages the rotary driving bit 25 with the second turn actuation portion 68 of the second turn latch bolt driver 58. This actuation causes a translational movement of the second turn latch bolt driver 58 indicated with arrow 67 in FIG. 7. This translational movement of the second turn latch bolt driver 58 in turn rotates the second turn latch bolt lever 59 in a first rotational direction indicated with arrow 75 in FIG. 7, which rotation causes a retraction of the latch bolt 5 as indicated with arrow 72 in FIG. 7.

In the illustrated embodiments, the second turn actuation portion 68 is formed by a face of protrusion 77 on the second turn latch bolt driver 58, which protrusion 77 also has a face acting as the follower portion 63.

When the lock 1 comprises two key actuated cylinder 16, 17, a second turn actuation portion 68 and a follower portion 63 have to be provided for each rotary driving bit 25. Consequently, there needs to be a second turn actuation portion 68 and a follower portion 63 on each side of the dead bolt lever 41. In the illustrated embodiments, this is achieved by having a two-fold structure for the bottom part of the second turn latch bolt driver 58 (see in particular FIG. 2). Specifically, the bottom part of the second turn latch bolt driver 58 is partly located on each side of the dead bolt lever 41. Transverse connections 80, 81 connect both parts of the bottom part of the second turn latch bolt driver 58 with one another ensuring that the entire second turn latch bolt driver 58 moves as a whole. Advantageously, one of the transverse connections 80 may also be used to anchor one end of spring 64.

The slidable connection between the dead bolt lever 41 and the second turn latch bolt driver 58 is preferably a protrusion-slot connection. Specifically, a protrusion 73 is provided on the dead bolt lever 41 cooperates with a slot 74 in the second turn latch bolt driver 58. The boundaries of the slot 74 act as a stop for possible movements of the second turn latch bolt driver 58. Specifically, the protrusion-slot connection limits the movement of the second turn latch bolt driver 58 along the first direction 67. In this way, there is no risk that the rotary driving bit 25 could pass the second turn actuation portion 68 when it would be rotated too far in the unlocking direction 60. If desired, the protrusion-slot connection may be replicated on both sides of the dead bolt lever 41.

Moreover, the protrusion-slot connection also influences the movement of the second turn latch bolt driver 58 along the second direction 79. In particular, as illustrated in FIG. 3, in the second angular position of the dead bolt lever 41, i.e. with the dead bolt 6 in its projecting position, protrusion 73 acts upon a side of the slot 74 to move the second turn latch bolt driver 58 entirely out of the circular path 26. Consequently, there is no risk that, when the dead bolt 6 is in its projecting position, rotation of the cylinder(s) 16, 17 could result in engagement of the second turn latch bolt driver 58 which could lead to movement of the latch bolt 5.

In the illustrated embodiments, the slot 74 is L-shaped with a first leg oriented along the first direction 78 and a second leg oriented along the second direction 79. However, other shapes would be equally suitable.

Although the present disclosure has been described in detail with reference to certain preferred configurations thereof, other versions are possible. Embodiments of the present disclosure can comprise any combination of compatible features shown in the various figures, and these embodiments should not be limited to those expressly illustrated and discussed. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A lock for a hinged closure member, the lock comprising:

a frame;

a dead bolt slidably mounted on the frame between a retracted position and a projecting position;

a dead bolt lever which is connected to the dead bolt and which is pivotally mounted on the frame between a first angular position, wherein the dead bolt is in its retracted position, and a second angular position, wherein the dead bolt is in its projecting position;

a first mounting means on a first face of the lock provided for mounting a first key actuated cylinder having a first rotary driving bit on the frame;

a second mounting means on a second face, opposite said first face, of the lock provided for mounting a second key actuated cylinder having a second rotary driving bit on the frame, wherein each rotary driving bit is rotatable upon actuation of the respective key actuated cylinder along a locking direction and an unlocking direction, opposite to said locking direction, each rotary driving bit being arranged to be rotated in said unlocking direction to act upon a respective first actuation element provided on the dead bolt lever to pivot the dead bolt lever from its second into its first angular position and to be rotated in said locking direction to act upon a respective second actuation element provided on the dead bolt lever to pivot the dead bolt lever from its first into its second angular position, wherein the first actuation elements are provided on opposite sides of the dead bolt lever and wherein the second actuations elements are provided on opposite sides of the dead bolt lever; and a locking mechanism arranged to lock the dead bolt in its retracted and its projected position, the locking mechanism comprising:

a spring biased lever mounted on the dead bolt lever and having a locking member;

a first catch provided on the frame; and a second catch provided on the frame, wherein said locking member is urged by said spring biased lever in said first catch when the dead bolt lever is in its first angular position to lock the dead bolt lever and thereby said dead bolt in its retracted position and wherein said locking member is urged by said spring biased lever in said second catch when the dead bolt lever is in its second angular position to lock the dead bolt lever and thereby said dead bolt in its projecting position, wherein each rotary driving bit is arranged to, when the rotary driving bit is being rotated in said locking direction, act upon said locking member before the rotary driving bit acts upon its respective second actuation element on the dead bolt lever to move said locking member out of said first catch to unlock said dead bolt from its retracted position and to, when the rotary driving bit is being rotated in said unlocking direction, act upon said locking member before the rotary driving bit acts upon its respective first actuation element on the dead bolt lever to move said locking member out of said second catch to unlock said dead bolt from its projecting position.

2. The lock of claim 1, wherein the spring biased lever is pivotally mounted on the dead bolt lever by means of a pivot and comprises a first end-part on a first side of the pivot and a second end-part on a second side of the pivot, opposite the first side, wherein the locking mechanism comprises a spring having a first end connected to the dead bolt lever and a second end connected to the second end-part of the spring biased lever, and wherein the locking member is provided on the first end-part of the spring biased lever.

3. The lock of claim 2, wherein the spring biased lever comprises two arms on opposite sides of the dead bolt lever, each arm being pivotally mounted on the dead bolt lever, said two arms being connected by the locking member on the first end-part of the spring biased lever.

4. The lock of claim 3, wherein said two arms are further connected by a transverse connection provided on the second end-part of the spring biased lever, said second end of the spring being fixed to the transverse connection.

5. The lock of claim 1, wherein the dead bolt lever is pivoted about a pivot with respect to the frame and connects with the dead bolt on a first distance from said pivot to move the dead bolt from its retracted to its projecting position or vice versa, each of said rotary driving bits engaging the first and the second actuation elements on the dead bolt lever on a second distance from said pivot, which second distance is smaller than said first distance.

6. The lock of claim 1, wherein said first catch and said second catch are provided on the first face of the lock and the locking mechanism comprises a further first catch and a further second catch provided on the frame on the second face of the lock, wherein said locking member is urged by said spring biased lever in said further first catch when the dead bolt lever is in its first angular position to lock the dead bolt lever and thereby said dead bolt in its retracted position and wherein said locking member is urged by said spring biased lever in said further second catch when the dead bolt lever is in its second angular position to lock the dead bolt lever and thereby said dead bolt in its projecting position.

7. The lock of claim 6, wherein the locking member is formed by a transverse pin extending through the dead bolt lever and having a first end cooperating with said first catch and said second catch, which transverse pin further has a second end, opposite the first end, cooperating with said further first catch and said further second catch.

8. The lock of claim 1, wherein said first catch and said second catch is formed by a slot in the frame.

9. The lock of claim 8, wherein said slot comprises a portion connecting said first catch and said second catch.

10. The lock of claim 1, wherein said dead bolt is guided in the frame by at least two openings therein which are coaxially aligned such that said dead bolt in its retracted position projects at least 3 cm from said lock.

11. A lock for a hinged closure member, the lock comprising:

a frame having a front plate;

a dead bolt slidably mounted on the frame between a retracted position and a projecting position, which dead bolt protrudes through said front plate out of the lock;

a dead bolt lever which engages the dead bolt and which is pivotally mounted on the frame between a first angular position, wherein the dead bolt is in its retracted position, and a second angular position, wherein the dead bolt is in its projecting position;

a latch bolt slidably mounted on the frame between a retracted position and a projecting position and urged to its projecting position by a latch bolt spring, which latch bolt protrudes through said front plate out of the lock;

a second turn latch bolt lever pivotally mounted on the frame and cooperating with the latch bolt to move the latch bolt from its projecting position to its retracted position against the latch bolt spring upon rotation in a first rotational direction;

a second turn latch bolt driver having a distal end which is pivotally mounted on said second turn latch bolt lever and a proximal end which is slidably connected to the dead bolt lever, the proximal end of the second turn latch bolt driver having reciprocal movement in at least a first direction and in a second direction wherein it moves substantially away from and towards said front plate, the second turn latch bolt driver being arranged to rotate the second turn latch bolt lever in said first rotational direction when being moved in said first direction substantially along said front plate; and mounting means provided for mounting a key actuated cylinder on the frame, the key actuated cylinder being provided with a rotary driving bit rotatable upon actuation of said key actuated cylinder and having a free extremity arranged to travel along a circular path along a locking direction and an unlocking direction, opposite to said locking direction, upon actuation of said key actuated cylinder, the rotary driving bit being arranged to be rotated in said unlocking direction to act upon a first actuation element provided on the dead bolt lever to pivot the dead bolt lever from its second into its first angular position and to be rotated in said locking direction to act upon a second actuation element provided on the dead bolt lever to pivot the dead bolt lever from its first into its second angular position, wherein the second turn latch bolt driver comprises a second turn actuation portion, the rotary driving bit being further arranged to, when said rotary driving bit is rotated in said unlocking direction with the dead bolt lever in its first angular position, act upon said second turn actuation portion to move the second turn latch bolt driver in said first direction to rotate the second turn latch bolt lever in said first rotational direction, wherein the lock further comprises a spring acting upon the second turn latch bolt driver to urge the second turn actuation portion in said second direction towards said circular path of said free extremity, and wherein said second turn latch bolt driver further comprises a follower portion, the rotary driving bit being further arranged to, when said rotary driving bit has passed said second actuation element in said locking direction without the dead bolt lever being moved into said second angular position and when the rotary driving bit is rotated further in said locking direction, engage said follower portion to move the second turn actuation portion in said second direction out of said circular path against said spring.

12. The lock of claim 11, wherein the slidable connection between the proximal end of the second turn latch bolt driver and the dead bolt lever comprises a protrusion cooperating with a slot.

13. The lock of claim 12, wherein, when the dead bolt lever is rotated from its first angular position to its second angular position, the protrusion urges against a side of the slot to move the second turn latch bolt driver, against said spring, out of the circular path of the rotary driving bit.

14. The lock of claim 12, wherein the slot is provided on the proximal end of the second turn latch bolt driver and the protrusion is provided on the dead bolt lever.

15. The lock of claim 12, wherein the slot is L-shaped.

16. The lock of claim 11, wherein said spring is fixed on one end to the proximal end of the second turn latch bolt driver and on the other end to the frame.

17. The lock of claim 11, wherein said first rotational direction is the same as said unlocking direction.

18. The lock of claim 11, wherein the second turn latch bolt driver comprises a protrusion having a front face and an end face, said follower portion being formed by the front face and said second turn actuation portion being formed by the end face.

19. The lock of claim 11, wherein the lock comprises further mounting means provided for mounting a further key actuated cylinder on the frame, the further mounting means being provided on an opposite face of the lock with respect to the mounting means, the further key actuated cylinder being provided with a further rotary driving bit rotatable upon actuation of said further key actuated cylinder and having a further free extremity arranged to travel along a further circular path along the locking direction and the unlocking direction upon actuation of said further key actuated cylinder, the further rotary driving bit being arranged to be rotated in said unlocking direction to act upon a further first actuation element provided on the dead bolt lever to pivot the dead bolt lever from its second into its first angular position and to be rotated in said locking direction to act upon a further second actuation element provided on the dead bolt lever to pivot the dead bolt lever from its first into its second angular position, wherein the second turn latch bolt driver comprises a further second turn actuation portion, the further rotary driving bit being further arranged to, when said rotary driving bit is rotated in said unlocking direction with the dead bolt lever in its first angular position, act upon said further second turn actuation portion to move the second turn latch bolt driver in said first direction to rotate the second turn latch bolt lever in said first rotational direction, and wherein said second turn latch bolt driver further comprises a further follower portion, the further rotary driving bit being further arranged to, when said further rotary driving bit has passed said further second actuation element in said locking direction without the dead bolt lever being moved into said second angular position and when the further rotary driving bit is rotated further in said locking direction, engage said further follower portion to move the further second turn actuation portion in said second direction out of said further circular path against said spring.

20. The lock of claim 19, wherein the second turn actuation portion and the follower portion are formed on a first part of the second turn latch bolt driver and the further second turn actuation portion and the further follower portion are formed on a second part of the second turn latch bolt driver, said first part and said second part being located on opposite sides of the dead bolt lever and being connected with a transverse connection.

* * * * *